United States Patent [19]

Kotcharian

[11] 4,199,909

[45] Apr. 29, 1980

[54] THERMALLY INSULATING, FLUID-TIGHT COMPOSITE WALL, PREFABRICATED ELEMENTS FOR CONSTRUCTING THE SAME AND METHOD OF CONSTRUCTING SAID WALL

[75] Inventor: Michel Kotcharian, Paris, France

[73] Assignee: Technigaz, France

[21] Appl. No.: 893,531

[22] Filed: Apr. 4, 1978

[30] Foreign Application Priority Data

Apr. 7, 1977 [FR] France ..... 77 10610
Mar. 30, 1978 [FR] France ..... 78 09299

[51] Int. Cl.[2] ..... E04B 1/62

[52] U.S. Cl. ..... 52/410; 114/65 R; 220/901

[58] Field of Search ..... 220/901, 450, 453; 52/269, 410; 114/65, 105

[56] References Cited

U.S. PATENT DOCUMENTS

| | | | |
|---|---|---|---|
| 485,810 | 8/1892 | Curtis et al. | 52/269 |
| 3,026,577 | 3/1962 | Dosker | 220/901 |
| 3,082,726 | 3/1963 | Dosker | 114/74 |
| 3,112,043 | 11/1963 | Tucker | 220/901 |
| 3,122,259 | 2/1964 | Meesen | 220/901 |
| 3,498,249 | 3/1970 | Jones | 114/65 |
| 4,021,982 | 5/1977 | Kotcharian | 220/453 |
| 4,050,608 | 9/1977 | Smith | 220/901 |
| 4,050,609 | 9/1977 | Okamoto et al. | 220/901 |
| 4,112,648 | 9/1978 | Suzuki et al. | 52/269 |
| 4,117,947 | 10/1978 | Androulakis | 52/410 |

FOREIGN PATENT DOCUMENTS

| | | | |
|---|---|---|---|
| 1331801 | 5/1963 | France | 220/901 |
| 1471637 | 1/1967 | France | 220/901 |
| 2120267 | 8/1972 | France | 220/901 |

*Primary Examiner*—James L. Ridgill
*Attorney, Agent, or Firm*—Steinberg & Blake

[57] ABSTRACT

The invention relates to a thermally insulating composite wall for any kind of tank on ships or on land. The wall comprises a self-supporting external wall, a bed of thermally insulating elements secured to said wall at least partially by means of a hardened packing material and a fluid-tight internal lining; said material may notably be a cellular material in contact with all the external surface of this bed and obtained by in situ expansion and subsequent hardening of a deformable product capable of spontaneous expansion which has been previously placed according to a discontinuous distribution.

24 Claims, 9 Drawing Figures

THERMALLY INSULATING, FLUID-TIGHT COMPOSITE WALL, PREFABRICATED ELEMENTS FOR CONSTRUCTING THE SAME AND METHOD OF CONSTRUCTING SAID WALL

The present invention relates to thermally insulating, fluid-tight composite walls for tanks and like vessels or containers for storing and/or transporting liquids or liquefied gases, for example for integrated tanks of the membrane type suitable for sea-borne transportation of liquefied petroleum gas.

The invention also relates to prefabricated elements for constructing the said walls, allowing the process of construction of the walls to be simplified.

The invention also relates to a method of constructing the said walls, preferably by means of the said prefabricated elements.

A thermally insulating, fluid-tight composite wall, when used for an integrated tank of the membrane type installed on a ship or like cargo vessel for transporting liquefied petroleum gases, includes, from the interior to the exterior of the tank:

a fluid-tight membrane or primary barrier in direct contact with the liquefied gas;

a supporting insulation of cellular material such as polyurethane foam, and a secondary barrier which may be integrated with said insulation, the function of said secondary barrier being possibly fulfilled by the ship's double hull.

To install such a structure, particularly the supporting insulation, panels of the desired cellular material are fabricated and a blanket of such panels with joint sealing means interposed therebetween is formed and fastened to the ship's double hull by means, in particular, of studs welded to the double hull.

The present invention applies particularly, but not exclusively, to thermally insulating walls of such a type. It relates generally to a thermally insulating, fluid-tight composite wall which is of simple and particularly efficient construction and allows the means secured to the self-supporting wall for fastening the supporting insulation to be dispensed with.

The thermally insulating, fluid-tight composite wall according to the invention is characterized in that it comprises a self-supporting external wall, at least one blanket or bed of thermally insulating elements attached to the said self-supporting wall and resting on a hardened or set packing or filling material initially placed in the deformable state between the said self-supporting wall and the said elements and ensuring, either alone or in association with fastening means secured to the said self-supporting wall, the fastening of the said blanket to the said self-supporting wall, films or layers of adhesive material and/or strips of thermally insulating material in the joints between the said elements, and an internal fluid-tight lining forming a primary barrier, of a material offering mechanical strength and cold-resistance.

According to one characterizing feature of the invention, the said lining material is a flexible laminated material adhesively secured to those surfaces of the said elements and of the said strips which face the said self-supporting wall.

The self-supporting external wall of the composite wall of the invention may be metallic (for example a ship's double hull) or of any other nature, for example of concrete (particularly in the case of land-based tanks).

Of course, the internal lining forming the primary barrier of the composite wall of the invention may be of any suitable structure known per se, in particular metallic, either of the even or level type or of the type presenting one or several corrugations or ribs.

According to a presently preferred form of embodiment of the composite wall of the invention, the said hardened or set packing or filling material is a cellular material filling up practically all the spaces located between the self-supporting wall and the blanket of thermally insulating elements so as to provide a continuous adhesive bond between substantially the whole external surface of the said blanket and the said self-supporting wall, the films or layers of adhesive material in the joints between the said panels and/or the said strips of insulating material possibly being of that same hardened cellular packing material, which material is obtained by in situ expansion, during the installation of the said bed of thermally insulating elements and subsequent hardening or setting, starting from a discontinuous distribution, particularly in lumps, patches or according to a lacunary arrangement, of a deformable material capable of spontaneous and preferably relatively slow expansion, previously arranged at least on the external face of the said bed and/or on the internal face of the self-supporting wall.

According to the invention, the said lining comprises individual sheets covering at least the major portion of the said elements and of the straps covering the said joints and extending beyond the edges of the latter so as to cover the edges of the said sheets.

The said elements advantageously comprise a body of cellular plastics material, particularly of polyurethane foam and, on the surface of the said body facing the self-supporting wall, a stress-distributing plate, for example a plate of ply or sheeted wood.

The thermally insulating elements may constitute prefabricated elements in which the plywood plate is adhesively bonded to the body of cellular plastics material and in which a fragment of the said lining is adhesively bonded to the face of the element which is opposite the one provided with the stress-distributing plate, the said fragment forming a sheet covering the said body.

According to an alternative embodiment of the present invention, the thermally insulating elements do not comprise such individual sheets of the aforesaid lining, the latter being formed by covering the blanket of thermally insulating elements, after fastening it to the self-supporting wall and filling in the joints between the said elements; this gives more freedom as regards the method of application of the lining, which may be constituted, for example, by parallel wide tapes with interposed adhesive, arranged on the bare surface of the bodies of cellular plastics material, for example in parallel relationship to one of the two directions of the joints of a blanket of elements (in the case of rectangular elements).

The material constituting the said fluid-tight lining forming the primary barrier may be selected among laminates comprising at least three superposed layers of plies, described in U.S. patent application Ser. No. 662,414 filed on Mar. 1, 1976 for a "Building material in particular for cryogenic confining structures and structures provided with such materials," and also in U.S. divisional patent application Ser. No. 748,755 filed on Dec. 8, 1976 for "Cryogenic tank," in the name of the present Applicant. Such a laminated lining material is advantageously constituted by at least four layers comprising, from the internal side, intended to be in contact with the fluid, to the external side: an internal layer forming a protective lining of elastomer, for example polyurethane elastomer or flexible epoxy resin, a first intermediate layer, a second intermediate layer of metallic nature, and an external layer, the said first intermediate layer and the said external layer offering mechanical strength and being constituted in particular by a fabric of mineral fibers such as glass fibers or a chemical textile material (either artificial or equivalent synthetic).

According to one form of carrying out the method of the invention for the construction of the thermally insulating wall, the packing or filling material on which the blanket of thermally insulating elements rests is applied to the surface of the thermally insulating elements, for example on the plate of ply or sheeted wood of the said elements of the material described in U.S. Pat. No. 4,003,174 of Jan. 18, 1977 for a "Method of mounting a composite wall structure and corresponding wall structure thus obtained," in the name of the present Applicant. It is recalled that the packing material is previously arranged on the external face of the thermally insulating elements or panels in lumps, patches or the like and that the thermally insulating elements or panels are thereafter brought to a final position by progressive crushing or flowing of the said lumps, which final position may be predetermined by abutment or bearing means or by locating or reference means; the Applicant has realized that an arrangement of the packing material equivalent to the arrangement in lumps or patches is an arrangement in tapes, particularly in tapes parallel to and spaced from one another, or an arrangement in layers comprising considerable reserves or gaps, or any other type of discontinuous arrangement allowing the packing material to be distributed, when the elements or panels are displaced in order to be brought to their final position.

According to another form of embodiment of the invention, the construction method consists in bringing the various thermally insulating elements of the said blanket to the final position which they must occupy with respect to the said self-supporting wall after coating the external face of the latter and/or the internal face of the said self-supporting wall with the said material in the deformable state and capable of spontaneous and relatively slow expansion, the said material being applied in a discontinuous arrangement, preferably in lumps, patches or in lacunary arrangement, in allowing the expansion and hardening or setting of the said material to take place spontaneously so as to provide a continuous adhesive bond between substantially the whole surface of the said blanket and of the said self-supporting wall while at the same time holding the said blanket in place during the said expansion, preferably by using shim elements and by applying in opposition to the expansion force of that material a counter-pressure of for example no more than 0.1 bar on the said thermally insulating elements. Use may also be made in this second form of embodiment of fastening means such as studs secured to the self-supporting wall, although this is not necessary in a great number of cases, in particular for land-based storage of cryogenic liquids. On the contrary, in equipping ships for transporting liquids or liquefied gases, such additional fastening may be useful. The various thermally insulating elements are then held in place in the aforementioned final position, during the expansion of the deformable material capable of slow and spontaneous expansion, by holding means cooperating with the studs and comprising for example bearing elements attached to the said studs and on which the external face of the said elements bears, shim elements being placed between the external face of those elements and the internal face of the self-supporting wall and/or the bearing elements attached to the said studs and bearing on the internal face of the said elements.

According to the present invention, the aforesaid fastening means consist of studs connected to the self-supporting wall and at least some of the edges of the stress-distributing plate of the above-mentioned specific thermally insulating elements project beyond the edges of the body of the said elements, the studs being placed between the adjacent elements and the edges of the plate resting on the aforesaid bearing means and being clamped against the latter by means of nuts locked, for example, by means of adhesive, connected to the said studs.

According to another characterizing feature of the present invention, the lateral sides of the thermally insulating elements are oblique, bevelled or chamfered, in opposite directions from one element to the one adjacent thereto, so as to provide between the said adjacent elements intermediate spaces occupied by the aforesaid strips, wider on the side of the said elements provided with the aforesaid lining than on the side of the said elements facing the self-supporting wall.

According to another characterizing feature of the invention, the said strips are constituted by prefabricated members of thermally insulating material fastened to the lateral sides of the said elements by means of adhesive; according to another characterizing feature of the invention, relating to an arrangement equivalent to the one just mentioned, the said strips are made of a thermally insulating material which has been injected in situ, has possibly been subjected to expansion in situ before hardening and is self-adherent to the lateral sides of the said elements.

According to another form of embodiment of the present invention, the body of at least some of the said thermally insulating elements, particularly of the angle elements, is provided with cavities whose bottom, formed by a portion of the aforesaid stress-distributing plate, has an axial orifice through which the said studs pass, the fastening of the panels to the self-supporting wall being obtained by clamping the said bottoms against the packing material by means of nuts locked for example by means of adhesive and connected to the said studs; of course, in order to preserve the continuity of the insulating blanket, the said cavities are provided with appropriately shaped plugs of a thermally insulating material adhesively and sealingly bonded to the body of the said elements; a stiffening ring may advantageously be placed on and preferably adhesively secured to the bottom of the said cavities within the interior of the latter in order to strengthen the fastening of the thermally insulating elements; a packing or filling material advantageously fills up the space between the plugs and the bottom of the said cavities. More generally, according to the present invention, the general structure of the thermally insulating elements of the dihedral angles and of the trihedral angles of the thermally insulating wall of the present invention may be one of those described in U.S. patent application Ser. No. 819,599 filed on July 27, 1977 by the present Applicant for a "Heat-insulating composite wall structure and method of mounting the same in a liquefied gas transportation and/or storage tank."

According to still another characterizing feature of the present invention, at least some of the joints between the adjacent thermally insulating elements are formed by the oblique lateral sides, parallel with one another, of the said elements, with an interposed film of thermally insulating material, constituted by adhesive; the obliquity of the said sides is for example from 30° to 45° with respect to the surface of the self-supporting wall. Such films may be formed from an adhesive composition or a fluid adhesive capable of undergoing expansion before the end of its hardening or setting.

Other characterizing features and advantages of the present invention will appear from the following description given solely by way of non-limitative example with reference to the appended drawings wherein.

Figure 1:
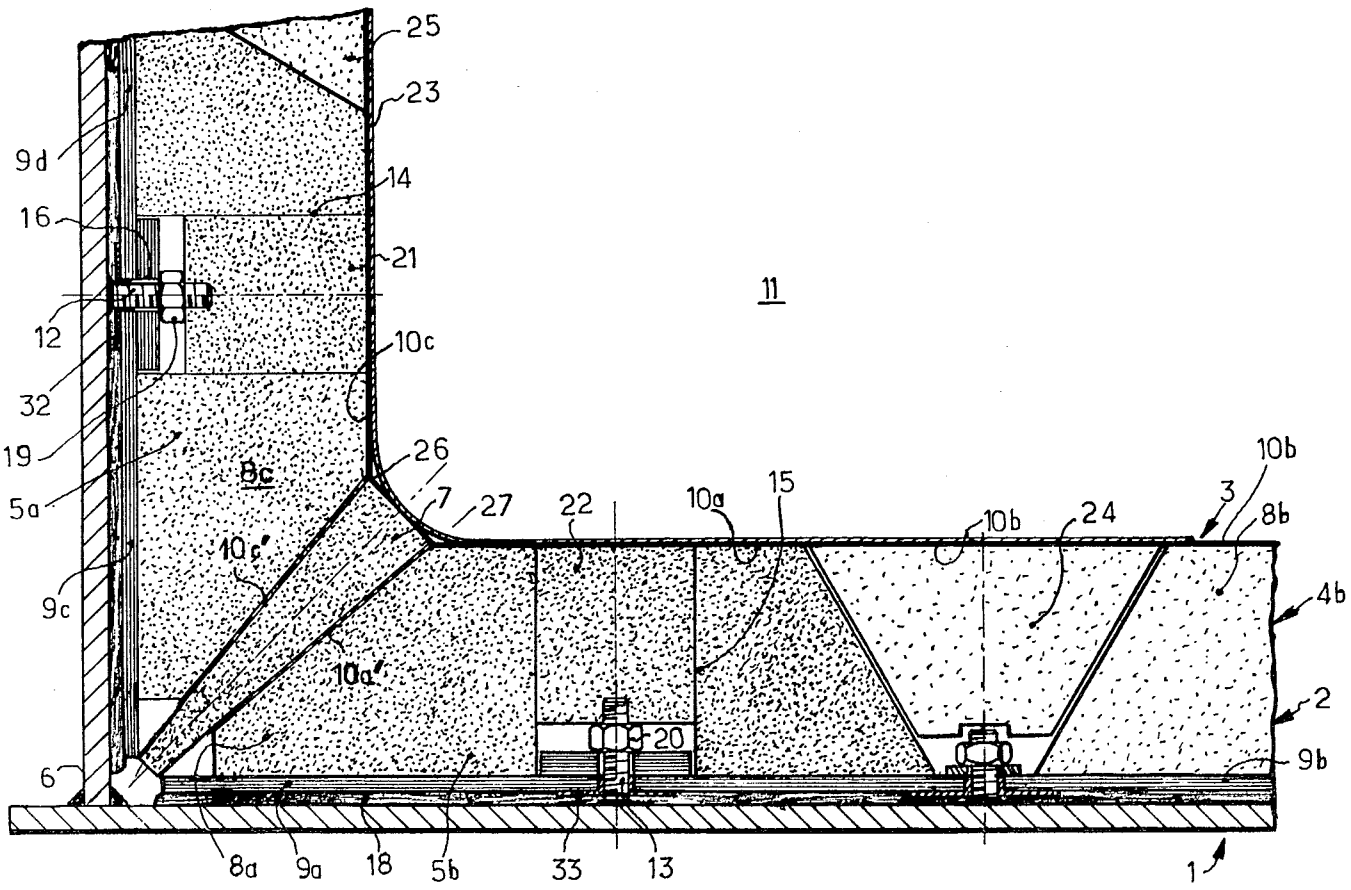
FIG. 1 is a cross-sectional view of a portion of a thermally insulating composite wall according to the invention, in the region of a dihedral angle.

There is shown in FIG. 1 a self-supporting metallic wall 1, e.g. the double hull of a ship or like cargo vessel, possibly forming a secondary fluid-tight barrier, a thermally insulating blanket or bed 2 constituted by juxtaposed thermally-insulating elements and a fluid-tight lining 3 of flexible laminated material offering mechanical strength and cold-resistance. The thermally insulating elements comprise substantially rectangular panels such as **4*b* covering each of the faces of the self-supporting wall, and stiffening blocks such as 5*a* and 5*b* which, seen from above, form elongated rectangular elements constituting pairs the two elements of which, such as, respectively, 5*a* and 5*b*, are placed at each side of the dihedral angle 6, with a corner wedge element 7, preferably of the same material as the body of the stiffening blocks 5*a*, 5*b* and the panel 4*b***, interposed between and bonded to the lateral sides of the stiffening blocks by means of an adhesive composition.

Each thermally insulating element is composed of a body 8 of cellular plastics material, in particular of polyurethane foam or of polyvinylchloride foam, of a plate 9 of ply or like sheeted wood adhesively bonded to the said body, for example by means of an adhesive composition, and of a sheet 10 of the aforementioned laminated material comprising at least four superposed layers including for example one external layer of glass fabric, one intermediate metallic layer of a metal such as for example aluminium, stainless steel or Invar alloy, another layer of glass fabric and an internal layer intended to be in contact with the liquid or the liquefied gas confined in the internal space 11 of the tank thermally insulated by the thermally insulating composite wall according to the present invention, the said internal layer being of an elastomer such as for example a polyurethane elastomer or a flexibilized epoxy resin.

In the various figures, the various portions of the thermally insulating elements are designated by the general reference numerals 8, 9 and 10 associated with a literal symbol specific to the element considered.

In the example illustrated in FIG. 1, the body of the stiffening blocks **5*a* and 5*b* as well as the angle wedge element 7 are of polyurethane foam of high density (for example of the order of 150 to 200 kg/m$^3$), whereas the body of the panels such as 4*b*** is of polyurethane foam with a mean density of the order of 80 kg/m$^3$; of course, these various thermally insulating elements may as well be of polyvinylchloride.

FIG. 1 illustrates the method of fastening the stiffening strips **5*a* and 5*b* to the self-supporting wall 1. To this end, studs such as 12 and 13 are welded at regular intervals in the medial zone of the stiffening blocks. In the region of each stud, the stiffening blocks are provided with a cylindrical cavity, such as the cavity 14 for the stud 12 and the cavity 15 for the stud 13, the bottom of which has an axial orifice, such as the orifice 16 for the recess 14 and the orifice 17 for the recess 15, through which the corresponding stud passes. The bottom of each cavity such as 14 or 15 is reinforced by means of a ring of ply or sheeted wood which is preferably adhesively secured to the said bottom, within the corresponding recess. The fastening of the stiffening blocks 5*a* and 5*b* to the self-supporting wall 1 by means of the said studs is achieved by securing the bottom of the recesses against the layer 18 of packing or filling material by means of nuts such as 19 and 20, the said nuts being advantageously anchored or locked by means of an adhesive composition, for example an adhesive of the epoxy type. The said cavities, such as 14, 15 are provided with plugs of thermally insulating material, such as the plug 21 for the cavity 14 and the plug 22 for the cavity 15, this material being in particular the same as that of the body 8*a* or 8*c*** of the stiffening blocks, the said plugs being sealingly bonded to the body of the stiffening blocks by means of an adhesive composition, for example an epoxy resin or a polyurethane adhesive composition.

Figures 3, 4, 5, 6, 7:
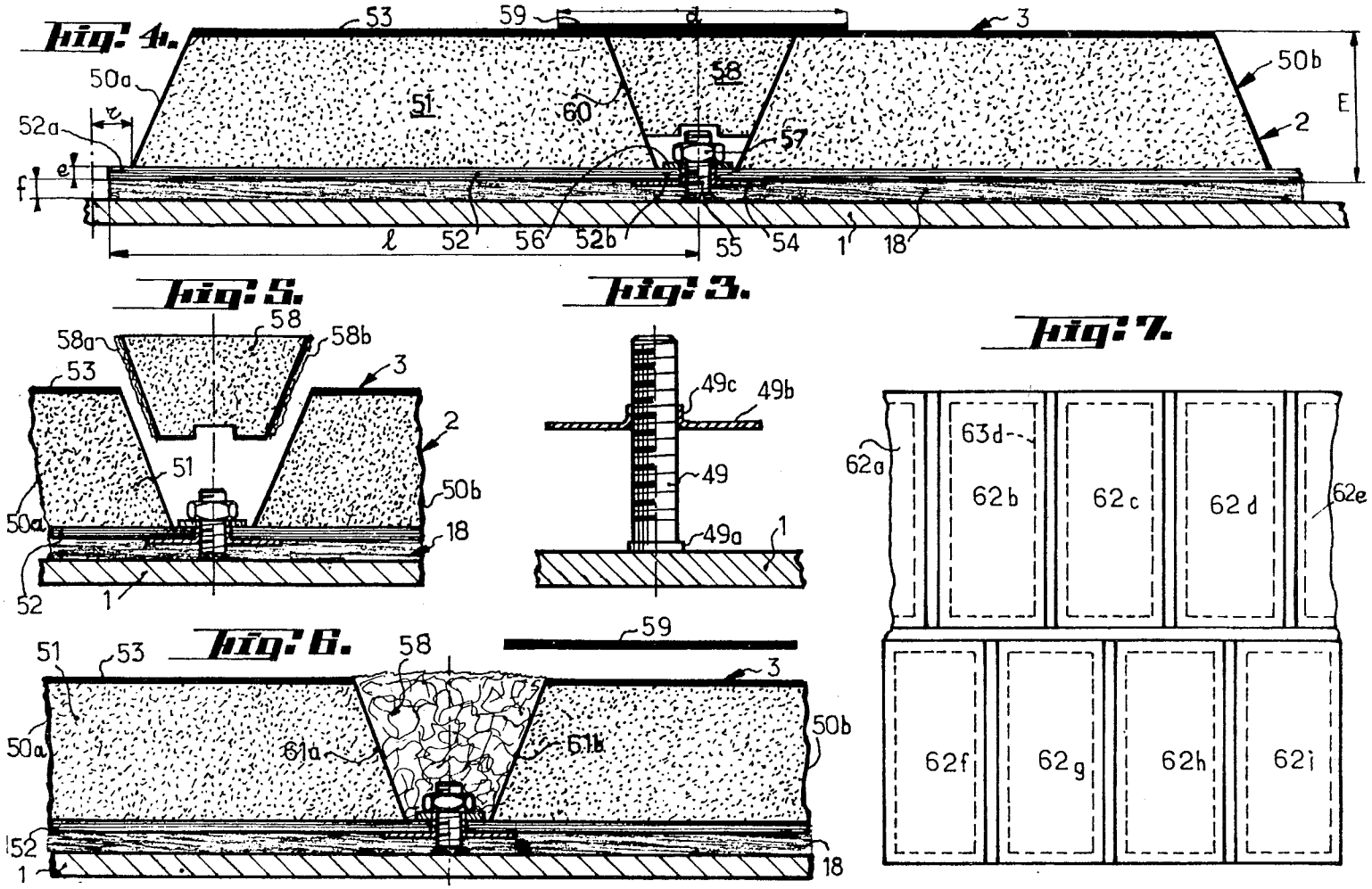
FIG. 3 is a detailed view of the bearing means connected to the studs used for fastening the blanket of thermally insulating elements according to the invention.
FIG. 4 is a cross-sectional view of a portion of the thermally insulating wall, also according to the invention.
FIG. 5 is another cross-sectional view of the portion of thermally insulating wall of FIG. 4, showing one way of providing strips at the joints between the thermally insulating elements.
FIG. 6 is another cross-sectional view of the portion of thermally insulating wall of FIG. 4, showing another way of providing strips at the joints between the thermally insulating elements.
FIG. 7 is a diagrammatic top view showing one possible arrangement of thermally insulating solid-wall elements constituted in this case by rectangular panels.

The intermediate spaces between the stiffening blocks such as **5*b* and the solid-wall panels such as 4*b* are occupied by strips such as 24 (or 25) of thermally insulating material preferably covering means of fastening the thermally insulating elements to the double hull 1; as regards such strips and fastening means, reference is made to the description of FIGS. 4, 5 and 6** relating to the strips and to the fastening means located in the intermediate spaces between the solid-wall panels, which are of identical structure.

The respective joints between the various elements (the stiffening blocks **5*a*, 5*b* and the panels adjacent thereto) are covered with a joint-cover strap 23 of the same laminated material as the sheets 10a, 10b and 10c, thus forming the continuous lining 3 offering thermal resistance, mechanical strength and fluid-tightness and forming a primary barrier. The sheets 10c and 10a extend at 10c' and 10a', respectively, onto the lateral sides of the stiffening blocks 5a and 5b, respectively, between which is interposed and adhesively secured the angle wedge element 7. It will be noted, furthermore, that a packing or filling material is placed at 26 and 27 between the angle wedge element 7 and the joint cover strap 24, so that, in the region of the dihedral angle 6, the primary barrier 3** has a regularly round shape with no angle nor fold.

It will be observed that, in the region of the plugs such as 21 and 22, the stiffening blocks such as 5a and 5b also rest on bearing means assembled to the studs such as 12 and 13, the said bearing means being constituted by rings, such as 32 and 33, screwed on the corresponding studs at a predetermined height thereof, thus allowing the exact final position of the stiffening blocks (or of any other thermally insulating element) to be predetermined and an accurate limit to be set to the progressive compression of the packing or filling material, forming the final layer 18, during the positioning of the thermally insulating elements, as previously mentioned.

Figure 2:
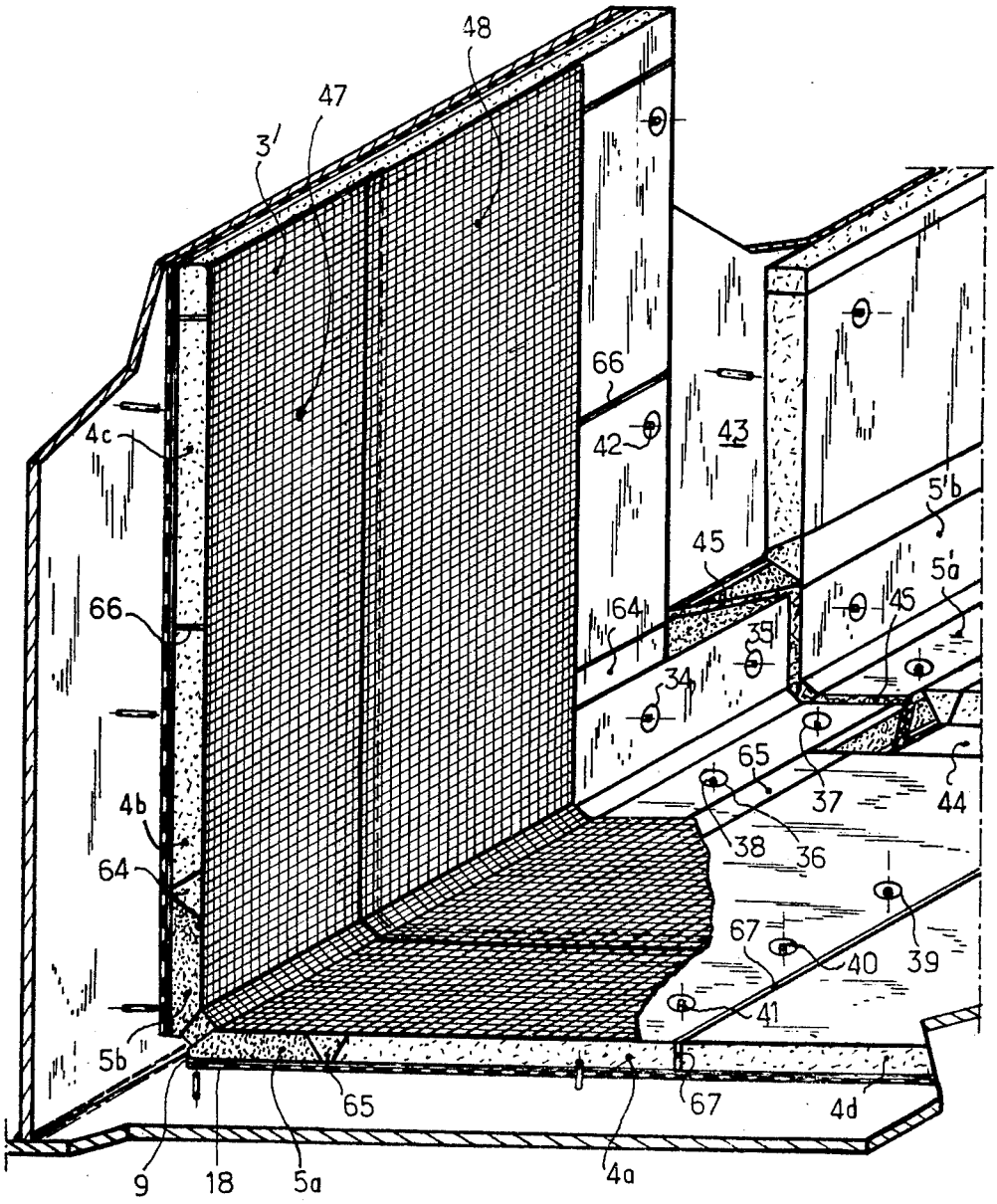
FIG. 2 is a perspective view of a portion of a thermally insulating composite wall according to the invention, wherein some of the thermally insulating elements have been intentionally omitted and the lining of laminated material is partially broken away.

In the perspective, partially broken away view of FIG. 2 are shown the same structural members as in FIG. 1 with identical reference symbols. The cavities of the stiffening blocks 5a and 5b, such as 34 to 37, are shown without the plugs closing them, thus allowing the ends of the studs, such as the stud 38 in the recess 36, to be seen. This figure illustrates the method of fastening the panels such as 4a, 4b and 4c, which are secured to the wall 1 by means of studs such as 39 to 42 in the same manner as described in connection with the studs such as 12 and 13 of the stiffening blocks 5a and 5b with reference to FIG. 1. The panels provided in the spaces such as 43 and 44 are not represented in FIG. 2 so as to show the nature of the joint between the stiffening blocks extending in prolongation of one another, i.e. between the stiffening blocks 5a and 5'a, on the one hand, and the stiffening blocks 5b and 5'b, on the other. It will be observed, in this respect, that the joint between the stiffening blocks 5a and 5'a comprises a film of thermally insulating and adhesive material 45 interposed between the end sides of the said stiffening blocks, obliquely with respect to the self-supporting wall. This material is constituted, in particular, by a thixotropic adhesive or a cement having equivalent properties; in this manner, the bonding surface of the stiffening blocks can be increased as compared with a joint perpendicular to the self-supporting wall, and the joint can be caused to work under shearing stress; the obliquity is for example from 30° to 45° with respect to the surface of the self-supporting wall 1.

The joints between the stiffening blocks and the adjacent solid-wall panels are for example obtained by means of strips such as 64 or 65 provided in the same manner as the strips 58 of FIGS. 4, 5 and 6 which will be described hereafter, whereas the joints between adjacent solid-wall panels are constituted by a cellular plastics material injected into the intermediate spaces such as 66 or 67 between the said panels.

Also seen in FIG. 2 is a lining 3' of laminated material forming a primary barrier, the nature of which may be the same as that of the laminated material described in connection with FIG. 1, but the arrangement of which is different since, in the case of FIG. 2, the lining 3' is formed of a succession of wide parallel tapes extending in perpendicular relationship to the largest dimension of the rectangular solid-wall panels such as 4a, 4b and 4c. Such lining tapes are of course arranged so that their edges mutually overlap as shown by the tapes 47 and 48, the said tapes being adhesively secured to the said thermally insulating elements after final positioning of the latter (the left edge of the tape 48 covers the right edge of the tape 47, being itself adhesively bonded to the latter).

In the detail view of FIG. 3 is again seen the self-supporting wall 1, a stud 49 welded to the latter at 49a and a metal ring 49b provided with an axial flange 49c and screwed on the stud 49, the said metal ring constituting for the thermally insulating elements a bearing means the level of which is adjustable by screwing or unscrewing. Although the use of such bearing means is not absolutely necessary, due to the use of the layer 18 of packing material (see FIG. 1 or FIG. 2), it is to be preferred, however, since in practice it allows the final location of the panels to be positively predetermined during the installation of the composite wall according to the invention, the position of the said ring defining the maximum degree of compression or crushing of the packing material during said installation. Untimely displacement of a ring such as 49b by screwing or unscrewing on the threaded stem of the stud before the installation of the thermally insulating elements can be prevented by using a lock-nut (not shown) or by adhesively fixing the thread.

Referring to the form of embodiment of the composite wall illustrated in FIGS. 4 to 6, there are shown the self-supporting wall 1, the blanket 2 of thermally insulating elements and the lining 3 of laminated material forming the primary barrier. The elements shown in these figures are solid-wall elements or panels designated at 50a and 50b, whereas the reference numeral 18 designates the layer of packing or filling material interposed between the said panels and the self-supporting wall 1. Each panel such as 50a comprises a body 51 of cellular plastics material, for example of polyurethane foam or polyvinylchloride foam of mean density, a ply or sheeted wood plate 52 provided on the surface of the said body which faces the self-supporting wall 1 and a sheet 53 of flexible laminated material offering mechanical strength and cold-resistance and placed on the internal face of the body 51, the said laminated material being in particular one of those mentioned above, preferably the one described in connection with FIG. 1. At least some of the edges of plate 52, such as the edges 52a and 52b seen in FIG. 4, project beyond the lateral sides of body 51 and rest upon bearing means constituted by metal rings, such as the ring 54, screwed on a row of regularly spaced studs, such as the stud 55. Flat metal rings, such as the ring 56, are interposed between the internal face of the edges such as 52a of adjacent panels and tightening nuts such as the nut 57 which is preferably anchored or locked by means of an adhesive composition applied to the thread of the nut or of the stud before tightening the nut. The oblique and oppositely directed lateral sides of adjacent panels 50a and 50b define a joint or intermediate space 60 in which is placed a strip 58 made of a thermally insulating material which may be the same as that of the bodies of panels 50a and 50b and which is sealingly bonded to the oblique lateral sides of the said panels by means of for example an adhesive composition such as an epoxy or a polyurethane adhesive or cement. A joint cover strap 59 of the same laminated material as that of the sheets such as 53 covering the insulating bodies such as 51 is adhesively secured to the internal surface of the strip 58 and on the confronting edges of the lining sheets of panels 50*a* and 50*b*, as shown, thus ensuring the fluid-tightness of the primary barrier.

In FIG. 5 showing the same elements as FIG. 4 it is seen that the strip 58 may be constituted by a prefabricated and preformed member which is merely inserted into the intermediate space 60 between the panels 50*a* and 50*b*. During its insertion into the intermediate space 60, the strip 58 is not covered with a joint cover laminated strap or sheet. Such a joint cover strap, such as 59 (FIG. 4), is applied after said insertion. To ensure the required fluid-tightness of the thermally insulating blanket, the lateral sides 58*a* and 58*b* of the strip 58 intended to be placed in contact with the lateral sides 61*a* and 61*b* of the panels 50*a* and 50*b* are coated with an adhesive composition such as for example an epoxy adhesive or cement.

FIG. 6 illustrates another way of providing the strip 58. In this case, polyurethane foam is injected between the panels 50*a* and 50*b* and is then allowed to harden. The upper face of the injected mass is thereafter made flush with the lining 3 (this can be avoided, according to a more advantageous alternative, by temporarily placing a limiting plate at the level of said lining during the injection). Thereafter, the joint cover strap 59 is adhesively secured on the strip 58 thus formed and on the endmost edges of the lining sheets, such as 53 in the case of panel 50*a*, of adjacent panels. Although the fluid-tightness thus obtained at the joint between the panels 50*a* and 50*b* is in practice sufficient, the lateral sides 61*a* and 61*b* of panels 50*a* and 50*b*, respectively, may advantageously be coated with an adhesive composition forming a finishing paint, preferably of elastomeric nature, for example an adhesive composition based on a polyurethane elastomer in case the body of panels 50*a* and 50*b* and the strip 58 are of polyurethane foam. Such an adhesive composition may be applied by means of a brush a few hours before injecting the polyurethane foam, thus increasing the adherence between the panels and the strip of injected cellular material.

For purposes of illustration, the following are some dimensional characteristics of the composite wall a portion of which is shown in FIG. 4: l=100 to 150 cm (the other dimension of the rectangular panels 50*a* and 50*b* being for example of the order of 300 cm); r=2 to 4 cm; d=20 to 25 cm; e=0.6 to 1 cm; f=0.5 to 2 cm; E=7 to 15 cm.

The solid-wall panels are for example assembled in rows shifted with respect to one another, as illustrated in FIG. 7. In this figure, the rectangular contours, such as 63*d*, of panels 62*a* to 62*i* are those of sheets of an elastomer film placed on the lining sheets of laminated material of the various panels for protection purposes, in which case the laminated material of the underlying said lining sheets does not include an internal elastomer layer but only an external glass-fabric layer, an intermediate metallic layer and an external glass-fabric layer. Such elastomer film sheets do not reach the endmost edges of the panels as in the case of the sheets such as 53 (FIG. 6) of laminated material, in order that the edges of the joint cover straps such as 59 (FIG. 6) may be adhesively secured directly to the edges of the lining sheets of laminated material such as 53 without overlapping the elastomer film. After adhesively securing the said joint cover straps of the same material as the lining sheets of the panels, an elastomer composition is projected onto the said straps as well as the peripheral edges of the sheets of elastomer film of the panels so as to form a continuous film over the whole internal surface of the blanket of insulating elements.

Another arrangement of the solid-wall panels consists in installing them in parallel rows without shifting, so that each joint between every two panels in a row extends in prolongation of a joint between the panels in the other rows.

Figure 8:
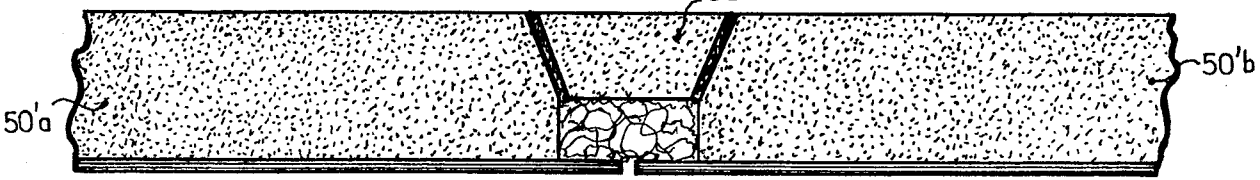
FIGS. 8 and 9 are cross-sectional views of other types of joints between the thermally insulating elements of a composite wall according to the invention.

In the joint structure in FIG. 8, where the means of fastening of the insulating elements have been intentionally omitted for the sake of increased clarity of the drawing, the intermediate space between panels 50'*a* and 50'*b* is filled, in its outer portion with parallel edges, with a foam of cellular plastics material injected in situ and therefore ensuring maximum fluid-tightness, whereas its inner portion with oblique edges in opposite directions is filled with an adhesively secured strip 58' of trapezoidal section ensuring maximum mechanical strength.

Figure 9:
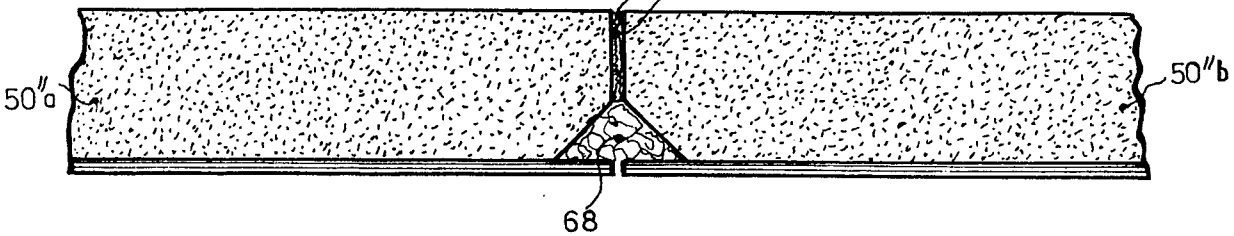

In the form of embodiment of FIG. 9, the intermediate space 68 provided in the outer portion of the joint between the panels 50''*a* and 50''*b* is filled with a cellular plastics material injected in situ, whereas the mutually parallel inner portions of the lateral sides of the panels are adhesively bonded to one another by means of an adhesive composition 69.

The said hardened or set cellular packing or filling material may be, in particular, an expanded epoxy resin or an expanded polyurethane resin.

It should be noted that, where use is made of a hardened cellular packing or filling material resulting from the expansion of a material placed discontinuously between the self-supporting wall and the thermally insulating elements, all the known types of materials capable of expansion and subsequent hardening or setting are not suitable, since either the expansion speed of such materials is too high or their hardening or setting is too rapid, or both, so that their use may result either in a displacement of the thermally insulating elements by reason of the excessive push applied by the expansion or in incomplete filling of the spaces between the self-supporting wall and the blanket of thermally insulating elements due to the hardening or setting occurring untimely, i.e. before the expansion is completed, or both at the same time. For this reason, the expandable material must preferably be capable of relatively slow expansion corresponding to a sufficiently small expansion pressure to allow the thermally insulating elements to be easily retained in position by maintaining, in opposition to the expansion force of the said material, a small counter-pressure of for example no more than 1/10th of a bar on the said thermally insulating elements.

According to a characterizing feature of the present invention, the application of the aforesaid product to the thermally insulating elements and/or the self-supporting wall, while it is in the deformable and expandable state, is made by means of a composition just prepared by mixing together an organic resin, a hardening or setting agent and an expansion agent. For filling up the spaces between the self-supporting wall and the blanket of thermally insulating elements, the use of epoxy resin is preferred by reason of the advantages it offers over polyurethane resin owing to its lower temperature of use, its slower expansion and the better mechanical properties of the hardened or set packing or filling material derived therefrom.

The deformable and expandable material suitable for forming the films of adhesive material in the joints between the said elements as a means of mutual adhesive bonding of the adjacent faces of such elements is preferably in the form of a fluid adhesive composition based in particular on epoxy resin or polyurethane resin.

The following are a few examples of compositions of the deformable and expandable material suitable for use in the present invention.

EXAMPLE 1

A composition based on epoxy resin suitable for filling up, by expansion, the space comprised between the blanket of thermally insulating elements and the external self-supporting wall consists of the following:

an epoxy resin known on the market under the denomination "5513 A": 100 parts by weight;

a hardening or setting agent known on the market under the denomination "5515 A": 65 parts by weight;

an expansion agent known on the market under the denomination "DY 650": from 3 to 4 parts by weight.

The characteristics of the hardened or set and expanded material obtained from the above composition are as follows:

density—230 kg/m$^3$
compressive strength—about 3 MPa
compressibility ratio—about 6%
modulus of elasticity—about 151 MPa
bending strength—about 5.5 MPa
shear strength—about 2 MPa

EXAMPLE 2

A composition which is in a more fluid condition than the preceding one when just prepared by mixing up its constituents is used as an expandable cement or adhesive composition for jointing or bonding together adjacent thermally insulating elements (forming of an expanded adhesive film):

an epoxy resin known on the market under the denomination "5521": 100 parts by weight;

hardening or setting agent known on the market under the denomination "LMB2226": 55 parts by weight;

an expansion agent known on the market under the denomination "DY 650": 4.5 parts by weight.

EXAMPLE 3

A composition forming a fluid cement or adhesive composition suitable for jointing together the adjacent faces of adjacent thermally insulating elements is prepared as follows:

polyurethane resin known on the market under the denomination "HK 8205 P": 100 parts by weight;

a hardening or setting agent known on the market under the denomination "HK 5410": 25 parts by weight;

water: 1.25 part by weight.

The constituents of the compositions of examples 1 and 2 are available at the Swiss company CIBA-GEIGY and the company called PROCHAL Société des Produits Chimiques de l'Allier, whereas those of example 3 are supplied by the firm HENKEL France.

The strips of thermally insulating material placed in the joints between adjacent thermally insulating elements may also be formed from the above-mentioned product in the deformable state and capable of spontaneous and slow expansion so that the said strips are finally constituted by a hardening or set cellular packing or filling material resulting from the hardening of the said product, the internal surface of the hardened material being preferably subjected to grinding in order to be made practically flush with the internal surface of the blanket of thermally insulating elements.

The advantages derived from the use of a deformable product capable of expansion prior to hardening or setting for filling up the space comprised between the self-supporting wall and the blanket of thermally insulating elements are as follows:

provision of a continuous adherent bonding between the said wall and the said blanket, thus increasing the safety of the bond and preventing any penetration of water or moisture through the blanket of thermally insulating elements and therefore into the liquid or liquefied gas;

confinement or limitation of the region of the self-supporting wall subjected to the thermal gradient produced by the contact of the cryogenic liquid with the said self-supporting wall in case of casual cracking of the blanket of thermally insulating elements throughout its thickness;

easy installation and saving of material by reason of the low density of the hardened and expanded packing material filling the spaces between the external self-supporting wall and the blanket of thermally insulating elements;

automatic taking up of, or compensation for, the defects and irregularities at the surface of the external self-supporting wall, i.e. of the local variations in thickness of the space located between the said wall and the blanket of thermally insulating elements;

possibility of dispensing with the stress-distributing plate, preferably of plywood, usually provided on the external face of the thermally insulating elements;

possibility of doing away with the specific discrete means of fastening the blanket of thermally insulating panels to the external self-supporting wall, such as for example the studs, by reason of the increased adhesion surface and the improved quality of said adhesion as a result of the expansion of the said product in the whole space defined between the self-supporting wall and the blanket of thermally insulating elements;

reduced stresses, particularly tractive stresses, at the thermally insulating elements in case of deformation of the self-supporting wall (for example of the ship's hull), owing to the continuous bearing of the said thermally insulating elements upon the hardened and expanded packing material; and improved absorption of all kinds of stresses, owing to the fact that the hardened and expanded material offers a certain amount of compressibility, for example of the order of 6% in the case of expanded epoxy resin.

Of course, the present invention is by no means limited to the forms of embodiment described and illustrated which have been given by way of example only. In particular, it comprises all means constituting technical equivalents to the means described as well as their combinations should the latter be carried out according to its gist and used within the scope of the following claims.

What is claimed is:

1. A thermally insulating, fluid-tight composite wall, which comprises successively, from the exterior to the interior, a self-supporting external wall; an initially deformable and subsequently hardenable packing material which is placed on said self-supporting external wall in deformable state and is thereafter hardened; a bed of thermally insulating elements placed on said packing material while the latter is still in deformable state so that the entire space between said self-supporting wall and said thermally insulating elements is filled by said packing material, and said bed is at least partially fastened to said self-supporting wall after hardening of said packing material, said thermally insulating elements defining between themselves joints wherein joining members are located and which join said thermally insulating elements; and a fluid-tight internal lining, forming a primary barrier, of a flexible laminated material offering mechanical strength and cold resistence.

2. A composite wall according to claim 1, characterized in that the external self-supporting wall is of a material selected from the group consisting of a metal and concrete.

3. Composite wall according to claim 1 wherein said joining members are layers of adhesive material.

4. Composite wall according to claim 1 wherein said joining members are strips of thermally insulating material.

5. A composite wall according to claim 1, characterized in that the said hardened packing material is a cellular material filling up practically all the space located between the self-supporting wall and the bed of thermally insulating elements, so as to provide a continuous adhesive bond between substantially the whole external surface of the said bed and the said self-supporting wall, the layers of adhesive material in the joints between the said panels or the said strips of insulating material possibly being of that same hardened cellular packing material, the latter being obtained by in situ expansion, during the installation of the said bed of thermally insulating elements, and by subsequent hardening, starting from a discontinuous distribution of a deformable product capable of spontaneous and relatively slow expansion, previously placed at least on the external face of the said bed or on the internal face of the self-supporting wall.

6. A composite wall according to claim 1, characterized in that the said hardened cellular packing material is selected from the group consisting of expanded epoxy resins and expanded polyurethane resins.

7. A composite wall according to claim 1, characterized in that the solid-wall elements, i.e. the elements corresponding to the non-angular portions of the self-supporting wall, consist of panels substantially rectangular in shape and arranged in rows, the joints between the panels in each row being shifted with respect to the joints of the panels in the adjacent rows.

8. A composite wall according to claim 1, characterized in that the elements corresponding to those regions of the self-supporting wall which form dihedral angles are constituted by pairs of elongated elements forming stiffening blocks, the elements of each of such pairs being placed on each side of the corresponding dihedral angle, and an angle wedge element being interposed between the two elements of each pair.

9. A composite wall according to claim 1, characterized in that at least some of the joints between adjacent thermally insulating elements are formed by oblique, mutually parallel end-faces of the said elements, between which is interposed a layer of thermally insulating material constituted by adhesive.

10. A composite wall according to claim 1, characterized in that the said lining material is a flexible laminated material adhesively secured to those surfaces said elements and said joining members which face the said self-supporting wall.

11. A composite wall according to claim 10, characterized in that the said lining includes individual sheets covering at least the major portion of the said elements and straps covering the said joints and extending beyond the edges of the latter so as to cover the edges of the said sheets.

12. A composite wall according to claim 10, characterized in that the said flexible laminated material includes at least four superposed layers, comprising an internal layer of elastomer, a first intermediate layer, a second, metallic intermediate layer and an external layer which, as the said first intermediate layer, is of mineral fiber.

13. A composite wall according to claim 10, characterized in that the said lining includes, on its internal face exposed to the fluid, a film of elastomer fulfilling a protecting function.

14. A composite wall according to claim 13, characterized in that the said film is obtained by projecting an elastomer composition onto said internal face.

15. A composite wall according to claim 1, characterized in that the said elements include a body of cellular plastics material and, on that surface of the said body which faces the self-supporting wall, a stress-distributing plate.

16. A composite wall according to claim 15, characterized in that at least some of the edges of the said plate project beyond the edges of the said body, said fastening means consisting of studs placed between adjacent elements are connected to said self-supporting wall and the edges of the said plate rest on adjustable bearing means connected to the said studs and are clamped thereagainst by means of locked nuts.

17. A composite wall according to claim 15, characterized in that the fastening means consisting of studs connected to said self-supporting wall are provided and the body of at least some of the said elements is provided with transverse cavities whose bottom formed by a portion of the aforementioned stress-distributing plate has an axial orifice which is traversed by at least some of the said studs, the fastening of the said elements to the self-supporting wall being obtained by clamping the said bottoms against the packing product by means of locked nuts connected to the said studs.

18. A composite wall according to claim 17, characterized in that the said cavities are provided with plugs of thermally insulating material sealingly bonded to the body of the said elements, and in that a stiffening ring is placed on the bottom of the said cavities within the latter.

19. A composite wall according to claim 1, characterized in that at least one of the inner and outer portions of the mutually adjacent lateral sides of mutually adjacent thermally insulating elements are oblique in mutually opposite directions, so as to provide between the said adjacent elements intermediate spaces in which the said strips are placed.

20. A composite wall according to claim 19 or 18, characterized in that a filling product is placed between the said strips and said plugs and the said stress-distributing plate.

21. A composite wall according to claim 19, characterized in that the said strips are wider at the inner side of the said elements than at their side directed towards the self-supporting wall.

22. A composite wall according to claim 19, characterized in that the said strips are constituted by prefabricated members of thermally insulating material fastened to the lateral sides of the said thermally insulating elements by means of adhesive.

23. A composite wall according to claim 19, characterized in that the said strips are of a thermally insulating material which has been injected in situ and is self-adherent to the lateral sides of the said elements.

24. A composite wall according to claim 23, characterized in that the said thermally insulating material is a cellular material which has been submitted to expansion in situ.

* * * * *